US005960996A

United States Patent [19]

Hsu

[11] Patent Number: 5,960,996

[45] Date of Patent: Oct. 5, 1999

[54] GAS-BURNED GLUE GUN

[76] Inventor: Ching-Mei Hsu, 3F, No. 33 Lane 80, Sec.4, Cheng-Te Rd., Taipei, Taiwan

[21] Appl. No.: 09/154,035

[22] Filed: Sep. 16, 1998

[51] Int. Cl.[6] ..... B67D 5/62

[52] U.S. Cl. ..... 222/113; 222/146.2; 401/1; 401/2; 126/401; 431/254

[58] Field of Search ..... 222/113, 146.2, 222/156, 157; 401/1, 2; 239/135, 139; 126/401, 408, 409, 413, 414; 431/254, 256, 326, 328, 329

[56] References Cited

U.S. PATENT DOCUMENTS

| | | | |
|---|---|---|---|
| 4,949,881 | 8/1990 | Watanabe et al. | 222/113 |
| 5,479,914 | 1/1996 | Tsai | 222/113 |
| 5,865,614 | 2/1999 | Hsu | 126/401 |

*Primary Examiner*—Henry J. Recla
*Assistant Examiner*—Tuan Nguyen
*Attorney, Agent, or Firm*—Bacon & Thomas, PLLC

[57] ABSTRACT

A gas-burned glue gun includes a gun body holding a heating unit and a melting unit, and a handle holding a fuel gas tank and a gas valve, the heating unit having a nozzle tube connected to the gas valve, an electronic igniter, a flame nozzle connected the nozzle tube, an ignition button, a wire electrode connected between the electronic igniter and the flame nozzle, a gas tube connected between the nozzle tube and the flame nozzle, a piston ring moved to close/open an air port on the gas tube, the melting unit having a heat conductive glue stick tube adapted to hold a glue stick, the heat conductive glue stick tube having a heat accumulating portion protected by a guard and disposed adjacent to the flame nozzle, and a catalyzer mounted in the heat accumulating portion, wherein when the ignition button is pressed on, the electronic igniter is triggered to produce sparks in igniting discharged fuel gas from the flame nozzle, and a flame is produced to heat the catalyzer, causing the catalyzer to produce a heating effect; when the ignition button is released, the piston ring is moved to close the air port of the gas tube, causing the flame to be extinguished.

9 Claims, 6 Drawing Sheets

GAS-BURNED GLUE GUN

BACKGROUND OF THE INVENTION

The present invention relates to a gas-burned glue gun, and more particularly to such a gas-burned glue gun which automatically extinguishes the flame after a catalyzer has been heated to produce a heating effect, enabling the catalyzer to be burned with flameless fuel gas and heat energy to be efficiently transmitted from the catalyzer to a heat conductive glue stick tube to melt a glue stick for sealing.

A regular heat melting glue gun is generally comprised of a magnetic ignition system and a fuel gas supply system. The fuel gas supply system comprises a rechargeable fuel gas tank mounted in a hollow handle at one end of the gun body, of the heat melting glue gun, a flame nozzle connected to the fuel gas tank through a gas tube, a wheel controlled to regulate the flow rate of discharged fuel gas. The ignition system is controlled by a control button to discharge a high voltage through a wire electrode, causing sparks to be produced at the front side of the flame nozzle, and therefore discharged fuel gas is burned in a combustion chamber into which the flame nozzle is moved by means of the control of a lever. When fuel gas is burned in the combustion chamber, a glue stick is melted in a melting chamber and driven out of a glue nozzle at the front side of the glue gun. This structure of heat melting glue gun is not safe in use because it is difficult to the control the flame during the operation of the heat melting glue gun. Furthermore, it takes much time to heat the melting chamber to a higher temperature than the melting point of the glue stick installed. There is another prior art structure of heat melting glue gun which uses an electronic ignition system to ignite discharged fuel gas, and a catalyzer to improve the heating efficiency. However, the catalyzer tends to be burned out quickly when heated by a flame through a length of time. There is known still another prior art structure of heat melting glue gun which uses a rechargeable storage battery and a heating coil for heating a glue stick. However, this structure of heat melting glue gun is still not satisfactory in function, because the capacity of the rechargeable storage battery is limited, and charging the rechargeable storage battery to a saturated status takes much time. This structure of heat melting glue gun cannot completely eliminate an electric leakage. Further, the temperature of the heating coil is not adjustable when heated, and the installed glue stick tends to be over-heated.

SUMMARY OF THE INVENTION

The present invention has been accomplished to provide a gas-burned glue gun which eliminates the aforesaid drawbacks. According to one aspect of the present invention, the gas-burned glue gun comprises a gun body holding a heating unit and a melting unit, and a handle holding a fuel gas tank and a gas valve, the heating unit having a nozzle tube connected to the gas valve, an electronic igniter, a flame nozzle connected the nozzle tube, an ignition button, a wire electrode connected between the electronic igniter and the flame nozzle, a gas tube connected between the nozzle tube and the flame nozzle, a piston ring moved to close/open an air port on the gas tube, the melting unit having a heat conductive glue stick tube adapted to hold a glue stick, the heat conductive glue stick tube having a heat accumulating portion protected by a guard and disposed adjacent to the flame nozzle, and a catalyzer mounted in the heat accumulating portion, wherein when the ignition button is pressed on, the electronic igniter is triggered to produce sparks in igniting discharged fuel gas from the flame nozzle, and a flame is produced to heat the catalyzer, causing the catalyzer to produce a heating effect; when the ignition button is released, the piston ring is moved to close the air port of the gas tube, causing the flame to be extinguished. According to another aspect of the present invention, a gas flow rate control knob is mounted in an opening at the handle and connected to the gas valve, and operated to regulate the flow rate of fuel gas passing out of the gas valve to the nozzle tube. According to still another aspect of the present invention, the heat conductive glue stick tube has an internally threaded coupling portion integral with the heat accumulating portion at a front side, and a bolt threaded into the internally threaded coupling portion; the gun body has a front through hole aligned with the internally threaded coupling portion of the heat conductive glue stick tube through which any of a variety of tool means can be inserted and connected to the internally threaded coupling portion after removal of the bolt from the internally threaded coupling portion.

DETAILED DESCRIPTION OF THE PREFERRED EMBODIMENT

Figure 1:
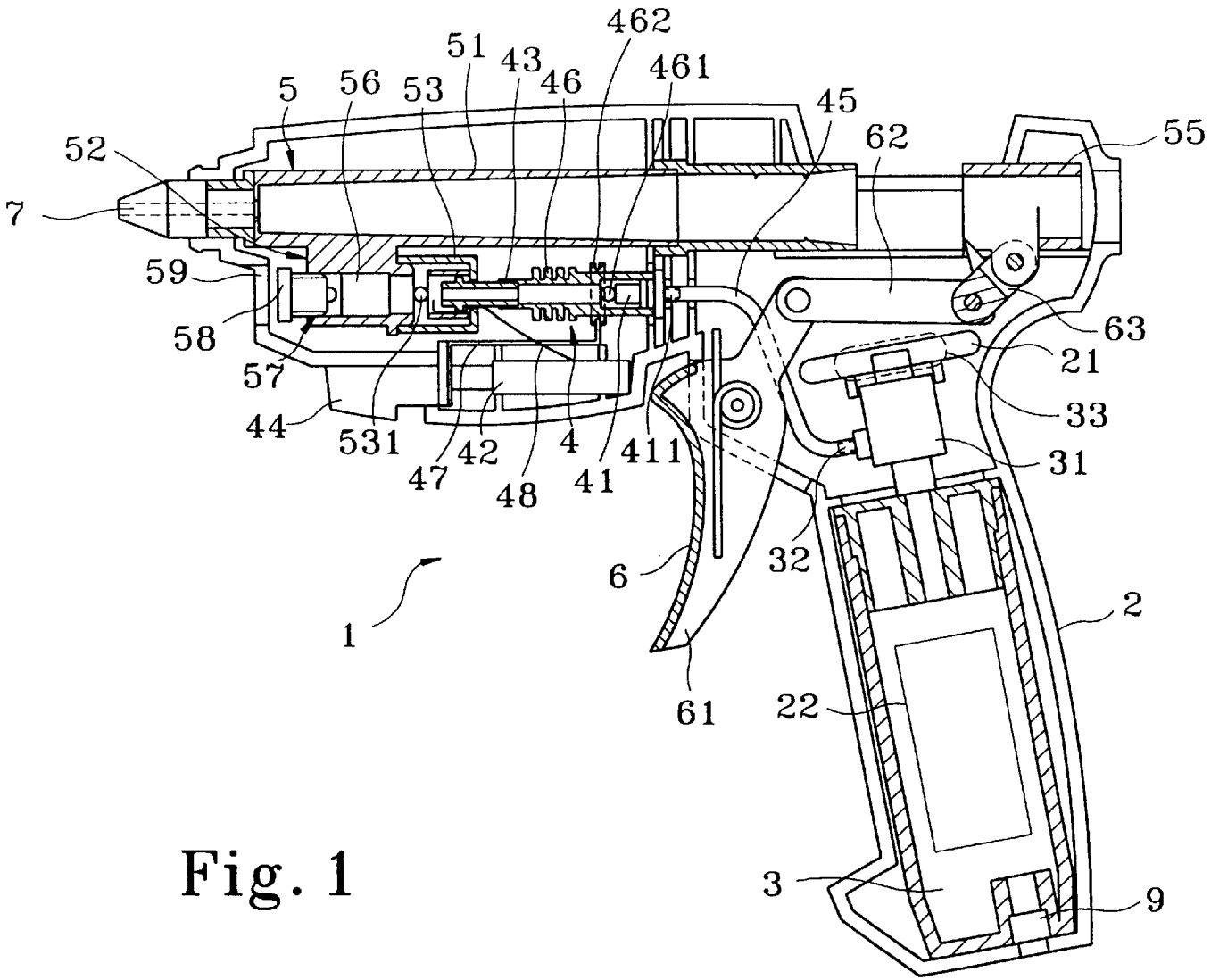
FIG. 1 is a plain view of a gas-burned glue gun according to the present invention.

Referring to FIG. 1, a gas-burned glue gun is shown comprised of a gun body 1, and a hollow handle 2. The handle 2 holds a fuel gas tank 3 on the inside, and a gas valve 31 connected to the fuel gas tank 3. The gas valve 31 has a gas output port 32 controlled by a gas flow rate control knob 33. The peripheral wall of the handle 2 has an opening 21 through which the gas flow rate control knob 33 extends partially to the outside of the handle 2 for operation by hand. A view window 22 is provided at the handle 2 corresponding to the fuel gas tank 3 through which the volume of fuel gas in the fuel gas tank 3 is viewed. The gun body 1 holds a heating unit 4 and a melting unit 5 on the inside. The heating unit 4 comprises a nozzle tube 41, and an ignition mechanism, which is comprised of an electronic igniter 42, a flame nozzle 43, an ignition button 44 mounted on the gun body 1, and a wire electrode 48 connected between the igniter 42 and the flame nozzle 43. The nozzle tube 41 has one end mounted with a gas inlet connector 411 connected to the gas output port 32 of the gas valve 31 through a gas tube 45, and an opposite end connected to the flame nozzle 43 by a gas tube 46. The gas tube 46 has an air port 461 through which outside fresh air passes to the inside of the gas tube 46 to mix with fuel gas into a fuel mixture for a complete combustion. A piston ring 462 is slidably mounted on the gas tube 46 and coupled to the ignition button 44 through a link 47, and moved with the ignition button 44 to close/open the air port 461.

The aforesaid melting unit 5 comprises a heat conductive glue stick tube 51 having a heat accumulating portion 52 disposed adjacent to the flame nozzle 43, an internally threaded coupling portion 57 at a front side of the heat accumulating portion 52, a bolt 58 threaded into the coupling portion 57 to prevent dissipation of heat energy, a guard 53 provided between the heat accumulating portion 52 and the flame nozzle 43, the guard 53 having an air hole 531, and a catalyzer 56 mounted in the heat accumulating portion 52. Further, the gun body 1 has a through hole 59 at its front side in alignment with the coupling portion 57. When the bolt 58 is removed from the coupling portion 57, a tool means 8 can be inserted through the through hole 59 and connected to the coupling portion 57 (see FIG. 5). The tool means 8 can be a soldering iron, a torch tip, an air blower, or any of a variety of cutting tools. Further, a glue stick propelling mechanism 6 is pivoted to the gun body 1 and coupled to the melting unit 5. The glue stick propelling mechanism 6 comprises a lever 61, a holder frame 63, and a link 62 having one end pivoted to the lever 62 and an opposite end pivoted to a holder frame 63. When the lever 61 is operated, the glue stick which is inserted through a guide tube 55 into the glue stick tube 51 is carried forwards by the holder frame 63.

Figure 2:
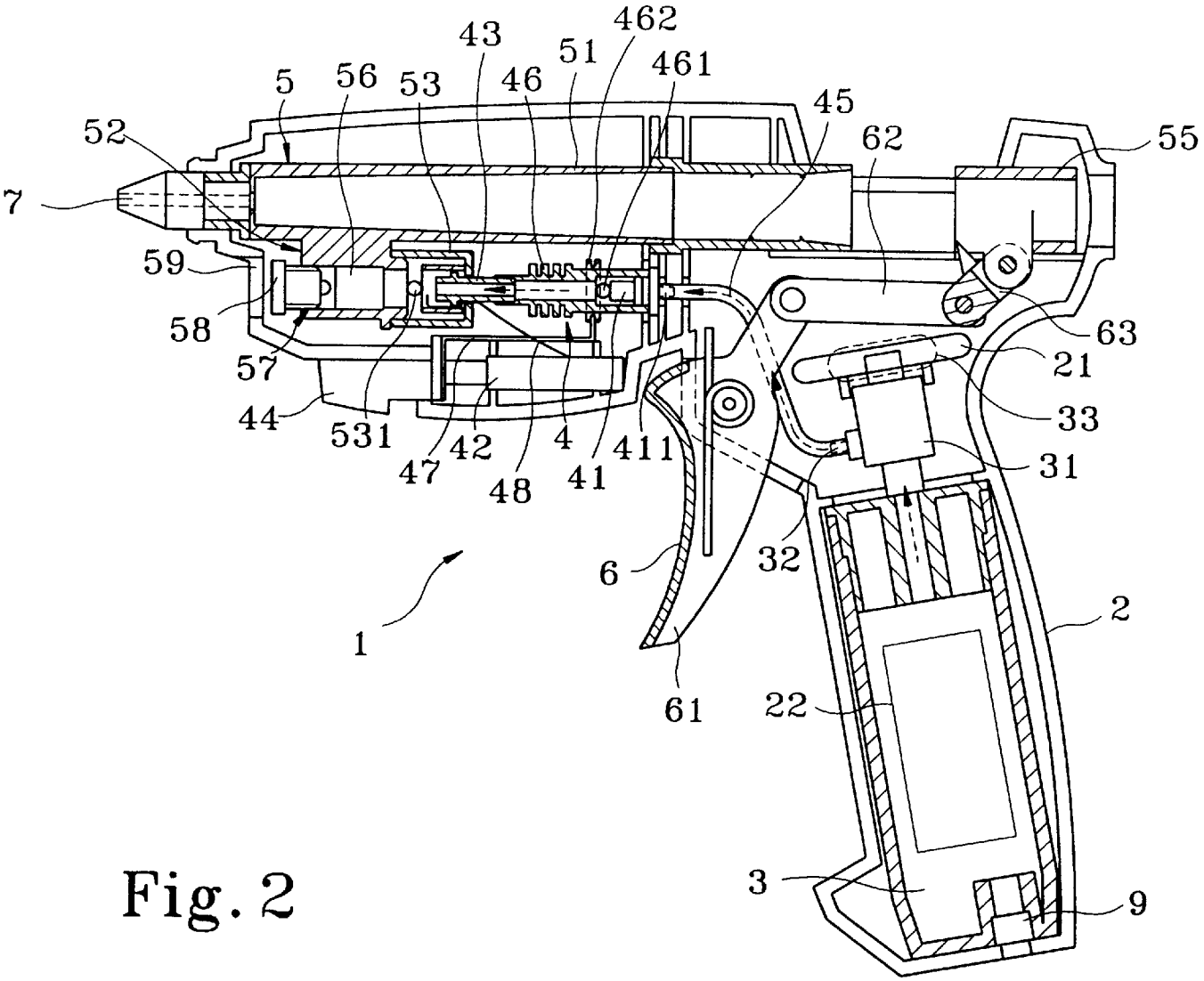
FIG. 2 illustrates the fuel gas path in the gas-burned glue gun according to the present invention.
Figure 3A:
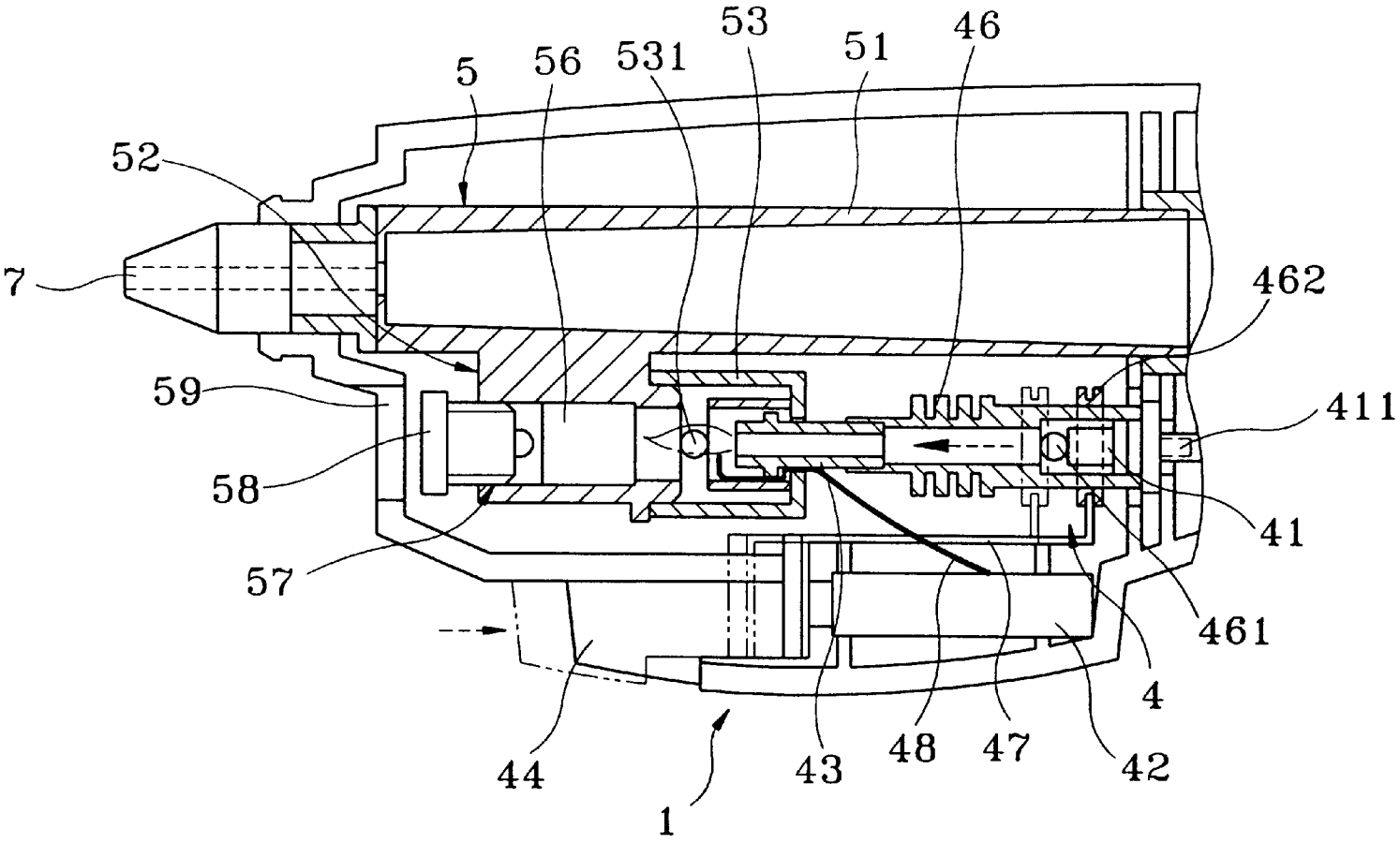
FIG. 3A is a plain view in an enlarged scale of a part of the present invention, showing a flame produced at the flame nozzle.
Figure 3B:
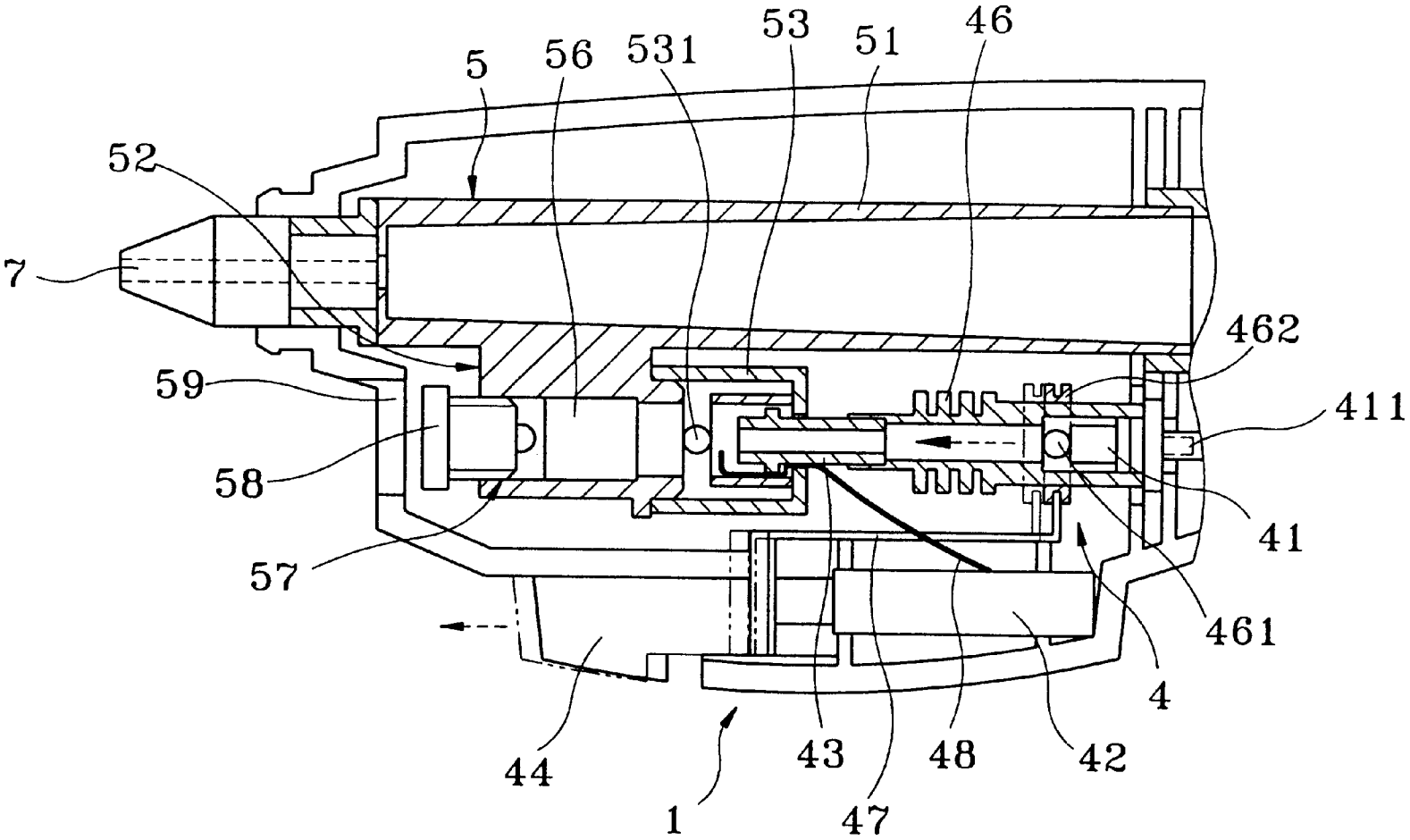
FIG. 3B is similar to FIG. 3A but showing the flame extinguished.

Referring to FIG. 2, 3A and 3B, when the gas flow rate control knob 33 is operated to open the gas valve 31, fuel gas flows from the fuel gas tank 3 through the gas output port 32 to the nozzle tube 31 via the gas tube 45, then flows out of the nozzle tube 31 into the gas tube 46 to mix with air. The fuel mixture thus formed immediately flows out of the flame nozzle 43. At the same time the ignition button 44 is depressed to move the link 47, causing the igniter 42 to discharge a high voltage through the wire electrode 48, and therefore sparks are produced to ignite the fuel mixture at the flame nozzle 43. The flame thus produced heats the catalyzer 56 in the heat accumulating portion 52. A certain length of time after heating (about 2–3 seconds), the ignition button 44 is released. When the ignition button 44 is released, the link 47 is returned to its former position, and the piston ring 462 is moved back to close the air port 461, thereby causing the fuel-air ration to be relatively changed and the flame to be extinguished. However, because fuel gas is continuously ejected out of the flame nozzle 43, discharged fuel gas is continuously flamelessly burned by the catalyzer 56, and heat energy is continuously transmitted from the heat accumulating portion 52 to the glue stick tube 51 to melt the inserted glue stick.

Figure 4:
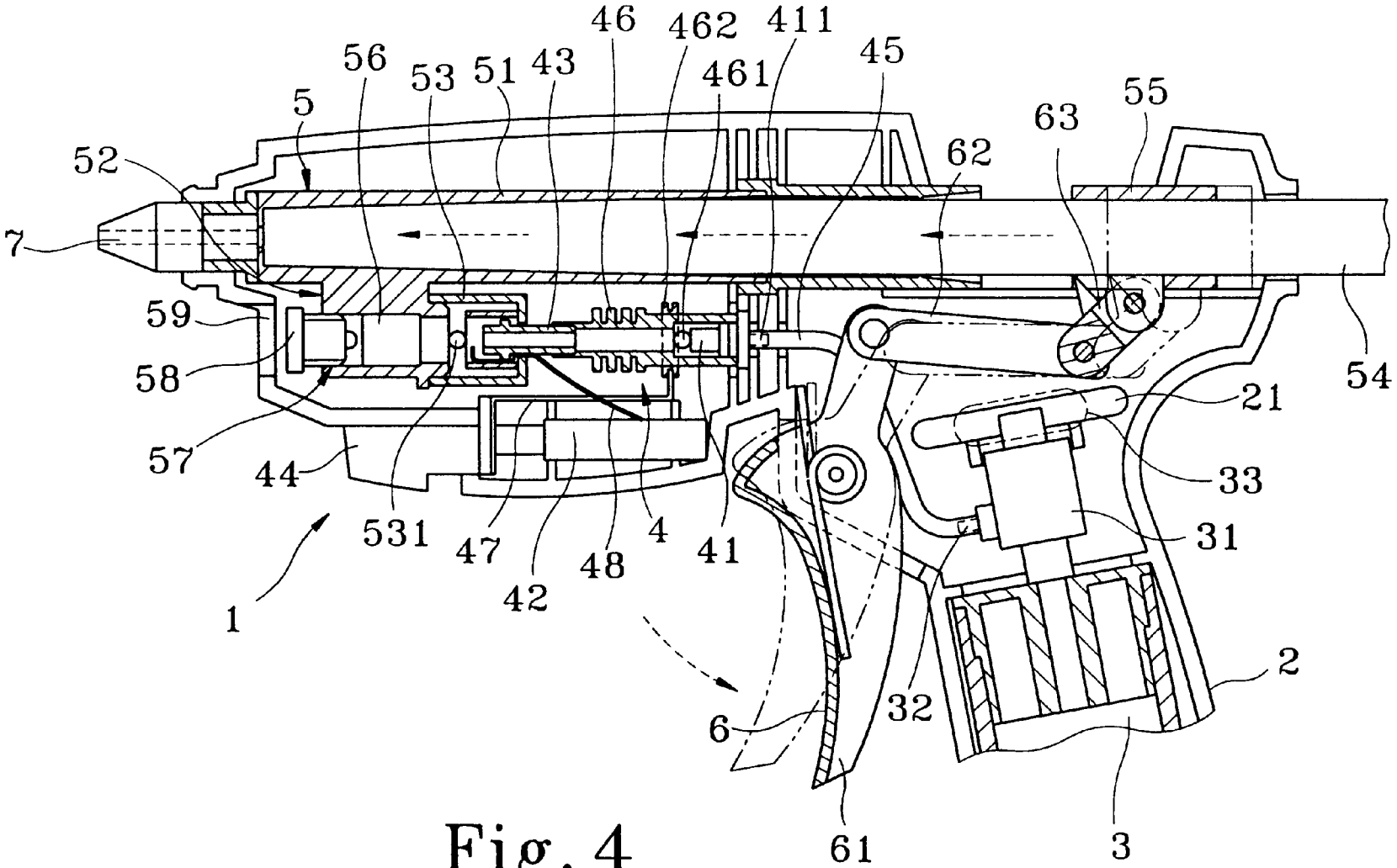
FIG. 4 is a plain view showing the moving direction of the inserted glue stick in the gas-burned glue gun according to the present invention.

Referring to FIG. 4, when the lever 61 is depressed, the holder frame 63 is driven by the link 62 to carry the inserted glue stick 54 forwards in the glue stick tube 51, enabling the front end of the inserted glue stick 54 to be melted and squeezed out of the metal glue nozzle 7 at the front side of the gun body 1. Through the gas flow rate control knob 33, the operator can control the flow rate of discharged fuel gas. Through the view window 22, the operator can visually check the volume of fuel gas in the fuel gas tank 3. When fuel gas is going to be used up, new supply of fuel gas can be filled in the fuel gas tank 3 through a filling valve 9 at the bottom side of the handle 2.

Because the catalyzer 56 is used to achieve a flameless burning, ignited flame is extinguished immediately after the catalyzer 56 has been heated to produce a heating effect, the heating efficiency is maintained at a high level, and the catalyzer 56 is prevented from being burned out. By means of regulating the gas flow rate control knob 33, the flameless burning temperature is controlled. Further, the filling valve 9 fits regular commercially available fuel gas can.

Figure 5:
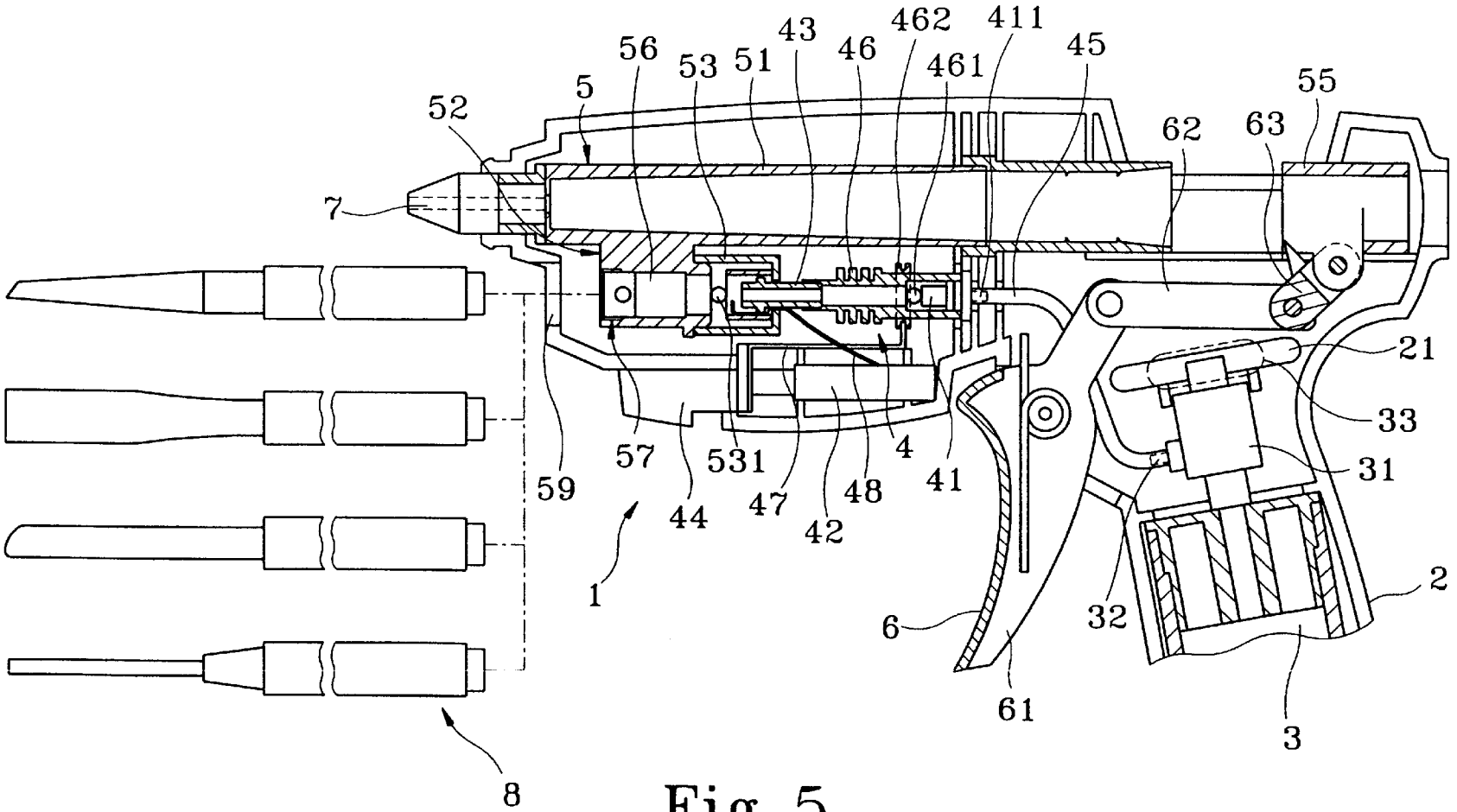
FIG. 5 is an applied view of the present invention.

Referring to FIG. 5, when the bolt 58 is removed from the coupling portion 57, a tool means 8 which can be a soldering iron, a torch tip, an air blower, or any of a variety of cutting tools can be inserted through the through hole 59 and connected to the coupling portion 57 for a different operation purpose.

What is claimed is:

1. A gas-burned glue gun comprising a gun body and a hollow handle connected to said gun body at one end, said handle comprising a fuel gas tank holding a fuel gas, and a gas valve connected to said fuel gas tank, said gun body comprising a heating unit and a melting unit on the inside, said heating unit comprising a nozzle tube connected to said gas valve, and an ignition mechanism, said ignition mechanism comprising an electronic igniter, a flame nozzle connected to one end of said nozzle tube remote from said gas valve, an ignition button mounted on said gun body, a wire electrode connected between said electronic igniter and said flame nozzle, a gas tube connected between said nozzle tube and said flame nozzle, said gas tube having an air port, a piston ring mounted on said gas tube and moved to close/open said air port, and a link coupled between said piston ring and said ignition button, said melting unit comprising a heat conductive glue stick tube adapted to hold a glue stick, a heat accumulating portion disposed adjacent to said flame nozzle and adjacent to said heat conductive glue stick tube, wherein said heat accumulating portion has an internally threaded coupling portion integrally formed at a front side opposite to said flame nozzle, and a bolt threaded into said internally threaded coupling portion, a guard provided between said heat accumulating portion and said flame nozzle, and a catalyzer mounted in said heat accumulating portion, wherein when said ignition button is pressed on, said electronic igniter is triggered to produce sparks in igniting discharged fuel gas from said flame nozzle, and a flame is produced to heat said catalyzer, causing said catalyzer to produce a heating effect; when said ignition button is released, said piston ring is moved with said link to close said air port of said gas tube, causing the flame to be extinguished.

2. The gas-burned glue gun of claim 1 wherein said a gas flow rate control knob is mounted in an opening at said handle and connected to said gas valve, and operated to regulate the flow rate of fuel gas passing out of said gas valve to said nozzle tube.

3. The gas-burned glue gun of claim 1 wherein said handle comprises a view window corresponding to said fuel gas tank through which the volume of fuel gas in said fuel gas tank is viewed.

4. The gas-burned glue gun of claim 1 wherein said gun body is mounted with a glue stick propelling mechanism operated to propel a glue stick in said heat conductive glue stick tube, said glue stick propelling mechanism comprising a lever pivoted to said gun body, a holder frame adapted to hold a glue stick in said heat conductive glue stick tube, and link means coupled between said lever and said holder frame.

5. The gas-burned glue gun of claim 1 wherein said gun body has a front through hole aligned with the internally threaded coupling portion of said heat conductive glue stick tube through which a tool means can be inserted and connected to said internally threaded coupling portion after removal of said bolt from said internally threaded coupling portion.

6. The gas-burned glue gun of claim 5 wherein said tool means is a soldering iron.

7. The gas-burned glue gun of claim 5 wherein said tool means is a torch tip.

8. The gas-burned glue gun of claim 5 wherein said tool means is an air blower.

9. The gas-burned glue gun of claim 5 wherein said tool means is a cutting instrument.

* * * * *